United States Patent [19]

Ohhashi et al.

[11] Patent Number: 4,564,392

[45] Date of Patent: Jan. 14, 1986

[54] HEAT RESISTANT MARTENSITIC STAINLESS STEEL CONTAINING 12 PERCENT CHROMIUM

[75] Inventors: Tateo Ohhashi; Hideyuki Kawamoto; Yutaka Murakami, all of Hokkaido, Japan

[73] Assignee: The Japan Steel Works Ltd., Tokyo, Japan

[21] Appl. No.: 632,174

[22] Filed: Jul. 19, 1984

[30] Foreign Application Priority Data

Jul. 20, 1983 [JP] Japan ..... 58-130773

[51] Int. Cl.[4] ..... C22C 38/44; C22C 38/46

[52] U.S. Cl. ..... 75/128 V; 75/128 F; 75/128 N; 75/128 G; 75/128 W

[58] Field of Search ..... 75/126 C, 126 E, 126 F, 75/126 J, 128 F, 128 N, 128 G, 128 W, 128 V; 148/37

[56] References Cited

U.S. PATENT DOCUMENTS 4,414,024 11/1983 Siga et al. ..... 75/126 J 4,477,280 10/1984 Shiga et al. ..... 75/128 W

FOREIGN PATENT DOCUMENTS 0102220 8/1979 Japan ..... 75/128 V

*Primary Examiner*—L. Dewayne Rutledge
*Assistant Examiner*—Deborah Yee
*Attorney, Agent, or Firm*—Sughrue, Mion, Zinn, Macpeak & Seas

[57] ABSTRACT

A heat resistant martensitic stainless steel having an improved creep rupture strength is described. This steel consists of, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, 0.05 to 0.50% vanadium, not more than 0.15% nitrogen, and, if desired, at least one of 0.02 to 0.50% columbium, 0.02 to 0.5% tantalum, 0.5 to 2.0% tungsten, and 0.0003 to 0.0100% boron, with the balance being iron and incidental or inevitable impurities, and wherein the weight ratio of carbon to nitrogen (C/N) is not more than 3:1.

7 Claims, 1 Drawing Figure

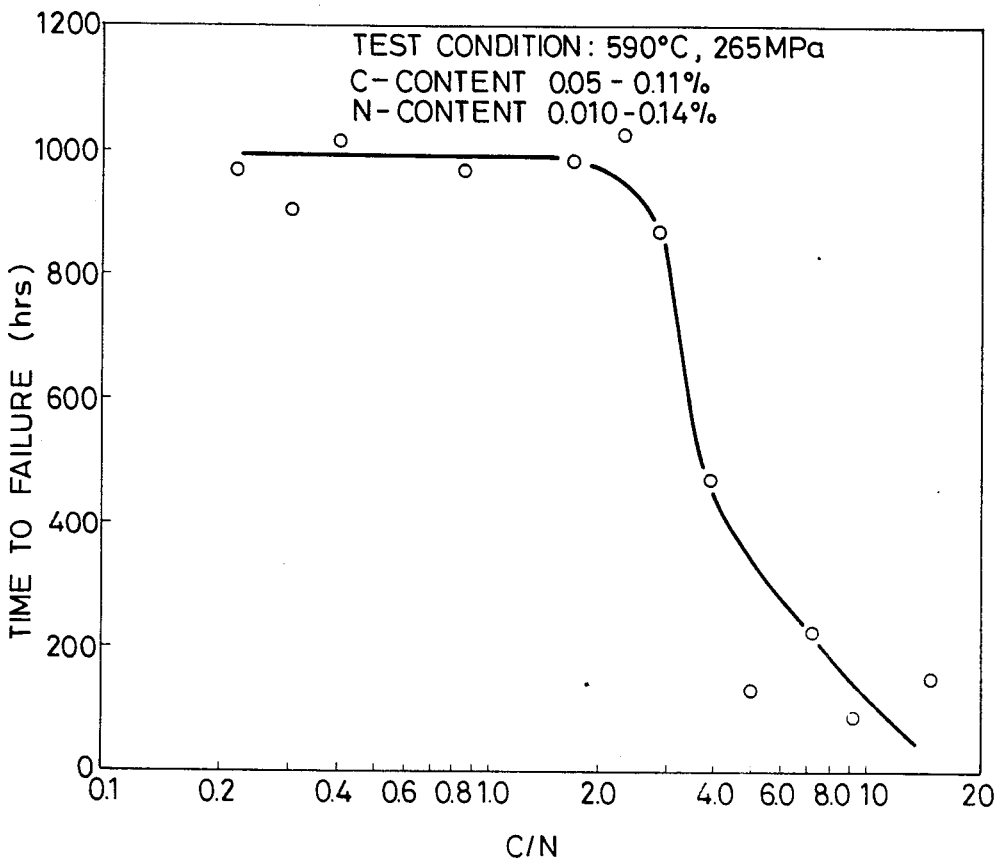
TEST CONDITION: 590°C, 265MPa
C-CONTENT 0.05 - 0.11%
N-CONTENT 0.010-0.14%
TIME TO FAILURE (hrs)
1200
1000
800
600
400
200
0
0.1
0.2
0.4
0.6
0.8
1.0
2.0
4.0
6.0
8.0
10
20
C/N

HEAT RESISTANT MARTENSITIC STAINLESS STEEL CONTAINING 12 PERCENT CHROMIUM

BACKGROUND OF THE INVENTION

Modern steam turbines for electric power generation require rotor shaft forgings of various sizes and mechanical properties. For high pressure (HP) turbines and intermediate pressure (IP) turbines, in particular, those of large size and intended to be used at high temperatures, 12% Cr—Mo—V steel, 12% Cr—Mo—V—Cb—N steel and 12% Cr—Mo—V—Ta—N steel have been used since they provide a good combination of high strength, toughness at high ambient temperatures, and high creep rupture strength, which are prerequisites for such components as rotor forgings, for HP, IP or HIP turbines in fossil-fuel fired power plants.

In recent years, new applications have been proposed which require HP and IP turbines to operate at higher temperatures than present state-of-the art turbines. The aforementioned steels containing 12% chromium, however, do not have sufficient creep and creep rupture strengths for such new designs. Therefore, it has been desired to develop a new heat resistant steel which is superior in creep rupture strength at much higher temperatures.

SUMMARY OF THE INVENTION

An object of the present invention is thus to provide a heat resistant martensitic stainless steel containing 12% chromium which is superior in creep rupture strength at high temperatures.

According to the present invention, it has been found that the high temperature creep rupture strength of 12% Cr-based heat resistant steels is greatly influenced not only by the amount of carbon and nitrogen added to the alloy, but also by the ratio of carbon to nitrogen as well. Specifically, in accordance with the invention, the creep rupture strength is 12% Cr-based heat resistant steel is greatly improved by controlling the carbon content to be less than 0.12% and the weight ratio of carbon to nitrogen to be not more than 3:1.

The present invention, in one preferred embodiment, provides a heat resistant martensitic stainless steel containing, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, and 0.05 to 0.50% vanadium, not more than 0.15% nitrogen, with the balance being iron and incidental or inevitable impurities, wherein the weight ratio of carbon to nitrogen (C/N) is not more than 3:1.

In another embodiment, the present invention provides a heat resistant martensitic stainless steel containing, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, 0.05 to 0.50% vanadium, not more than 0.15% nitrogen, at least one of 0.02 to 0.50% columbium, 0.02 to 0.5% tantalum, 0.5 to 2.0% tungsten and 0.0003 to 0.0100% boron, with the balance being iron and incidental or inevitable impurities, wherein the weight ratio of carbon to nitrogen (C/N) is not more than 3:1.

BRIEF DESCRIPTION OF THE DRAWING

The single FIGURE illustrates the results of creep rupture tests performed at 590° C. with an applied stress of 265 MPa, showing the relationship between time to failure and the ratio of carbon to nitrogen (C/N) of 12% Cr—Mo—V—N alloys.

DESCRIPTION OF THE PREFERRED EMBODIMENTS

The present invention, as mentioned above, is derived from the finding that the creep rupture strength of heat resistant martensitic stainless steels containing 12% chromium can be greatly improved by controlling the carbon and nitrogen contents within the above-specified ranges and ratio. Thus, the 12% Cr-based heat resistant steel of the present invention is much superior to conventional 12% Cr-based heat resistant steels with respect to creep rupture strength.

The reasons for which the composition of the material of the present invention is limited to the abovespecified ranges will hereinafter be explained.

(a) Carbon

The carbon content should be 0.05 to 0.12 weight percent.

Carbon stabilizes the austenitic structure at high temperatures, forming a solid solution and expanding the lattice of the alloy during martensitic transformation, thereby hardening the steel greatly after quenching. Then carbon reacts with such as tantalum, columbium, molybdenum, etc. during aging, forming carbides which are stable at high temperatures, thus resulting in a considerable increase in the creep rupture strength.

If the carbon content is less than 0.05%, the above-described effects cannot be obtained sufficiently. On the other hand, if it is in excess of 0.12%, formation of coarse carbides or aggregations of carbides is likely to occur. This leads to a decrease in creep rupture strength and also to a drop in toughness at low temperatures. Thus the carbon content should be from 0.05 to 0.12%.

(b) Silicon

The silicon content should be not more than 0.5 weight percent.

Silicon serves as a strong deoxidizer in smelting and refining procedures, should it be intentionally added. If, however, added in excess, it results in a reduced toughness at low temperatures. Thus, it is desirable to keep the silicon content as low as possible. Accordingly, the silicon content is limited to not more than 0.5% in the steels of the present invention. In cases, therefore, when vacuum carbon deoxidization is employed, it is not required to intentionally add silicon.

(c) Manganese

The manganese content should be not more than 1.5 weight percent.

Manganese is a weak deoxidizer. However, the main purpose of its addition to steels is to stabilize the sulfur content by forming manganese-sulfides. If the manganese content is in excess of 1.5%, then the toughness at low temperatures and the creep rupture strength at high temperatures drop. Therefore the manganese content is limited to not more than 1.5%.

(d) Nickel

The nickel content should be not more than 1.5 weight percent.

Nickel is an element which is effective in increasing the hardenability of steels, thus improving the toughness of alloys, and it also inhibits delta-ferrite formation, which reduces both toughness at low temperatures and strength at elevated temperatures. If, however, added in excess of 1.5%, it reduces the creep rupture strength, which is the prime concern of the present invention. Therefore, the upper limit of the nickel content is set to 1.5%.

(e) Chromium

The chromium content should be from 9.0 to 13.0 weight percent.

Chromium is an element which forms a solid solution with iron, thereby increasing the elevated temperature strength of the alloy. It, furthermore, improves the resistance of the alloy to oxidation and corrosion. If the chromium content is less than 9%, the strength, oxidation resistance and corrosion resistance of the alloy are unsatisfactory. On the other hand, if it is in excess of 13%, an undesirable delta-ferrite structure will disperse in the alloy. This leads to a decrease in ductility and toughness at low temperatures, and also to a reduction in creep strength at high temperatures. Thus, the chromium content should be from 9.0 to 13.0%.

(f) Molybdenum

The molybdenum content should be from 0.5 to 2.0 weight percent.

As previously mentioned, molybdenum forms carbides, which is very effective in improving the strength of the alloy both at low and elevated temperatures. It also prohibits ferrite formation upon cooling from the quenching temperature, thus increasing the toughness of the steel through improved hardenability. Recently, another important role of molybdenum has become apparent, namely, the inhibiting of temper embrittlement during service at high temperature. If the molybdenum content is less than 0.5%, the above-described effect is obtained only insufficiently. On the other hand, if it is in excess of 2.0%, undesirable delta-ferrite formation will occur in the alloy structure. This leads to a reduction in both toughness and strength at low and high temperatures. Therefore, the molybdenum content should be from 0.5 to 2.0%.

(g) Vanadium

The vanadium content should be from 0.05 to 0.50 weight percent.

Vanadium, if present in a proper amount, increases the creep rupture strength of alloys drastically through the formation of uniformly dispersed fine carbides. If the vanadium content is less than 0.05%, the aforementioned effects are obtained only insufficiently. On the other hand, if it is in excess of 0.5%, there is an increased tendency of delta-ferrite formation, which is undesirable for the purposes of the invention. Accordingly, the vanadium content should be from 0.05 to 0.5%.

(h) Nitrogen

The nitrogen content should not be more than 0.15 weight percent.

The presence of nitrogen results in austenite formtion at high temperature and prevents undesirable delta-ferrite formation. Furthermore, it increases the creep rupture strength by forming nitrides or carbonitrides in combination with other elements. If, however, added in excess of 0.15%, it increases the formation of gas-porosities or microporosities. Thus, the upper limit of the nitrogen content is set at 0.15%.

(i) Columbium

The columbium content should be from 0.02 to 0.50 weight percent.

Columbium has a strong affinity with carbon and with nitrogen, and thus it forms very fine, uniformly dispersed carbides and carbo-nitrides in the matrix of the alloy. Its beneficial effect on the mechanical properties of the alloy is to increase the creep rupture strength. Furthermore, it prevents coarse grain formation during forging and heat treatment, thereby increasing toughness at low temperatures. For this reason, the columbium content should be at least 0.02%. Columbium, however, accelerates the formation of the ferrite phase, and the precipitation of the excess amount of carbides and/or carbo-nitrides leads to a reduction in toughness. Thus, it is necessary to keep the columbium content less than 0.50%. Accordingly, the columbium content should be from 0.05 to 0.50%.

(j) Tantalum

The tantalum content should be from 0.02 to 0.50 weight percent.

Tantalum, like columbium, has a strong affinity with carbon and with nitrogen, and thus it forms very fine, uniformly dispersed carbides and carbo-nitrides in the matrix of the alloy. Its beneficial effect on the mechanical properties of the alloy is to increase the creep rupture strength. Furthermore, it prevents coarse grain formation during forging and heat treatment, thereby increasing toughness at low temperatures. Therefore, the tantalum content should be at least 0.02%. Tantalum, however, accelerates the formation of the ferrite phase, and the precipitation of an excess amount of carbides and/or carbo-nitrides leads to a reduction in toughness. Thus, it is necessary for the tantalum content to be less than 0.50%. For these reasons, the tantalum content should be from 0.05 to 0.50%.

(k) Tungsten

The tungsten content should be from 0.5 to 2.0 weight percent.

Tungsten resembles molybdenum chemically, and therefore its effect on the properties of the alloy is quite similar to that of molybdenum, except for inhibiting temperature embrittlement. If, however, the tungsten content is less than 0.5%, these effects will be insufficient. On the other hand, if it is added to the alloy in excess of 2.0%, undesirable delta-ferrite formation will result. This leads to a reduction in high and low temperature strengths. Thus, the tungsten content should be from 0.5 to 2.0%.

(l) Boron

The boron content should be from 0.0003 to 0.0100 weight percent.

Addition of a small amount of boron increases the hardenability and also the creep rupture strength of alloys. If, however, the boron content is less than 0.0003%, a sufficient effect can not be obtained. On the other hand, if it is added in excess of 0.0100%, large amounts of complex compounds will precipitate at grain boundaries, resulting in a reduction in notch toughness. Thus, the boron content should be from 0.0003 to 0.0100%.

(m) Carbon/Nitrogen Weight Ratio

This is the most significant factor in the present invention. Carbon and nitrogen are elements which, as described previously, promote the precipitation of fine carbides and carbo-nitrides, and thereby they increase the creep rupture strength at elevated temperatures. If the weight ratio of carbon to nitrogen is controlled appropriately, and also if the upper limit of the carbon content is specified as described above, the fine precipitates will uniformly disperse in the matrix, resulting in an increase in the creep rupture strength. If the carbon to nitrogen weight ratio is in excess of 3:1, however, the presence of the surplus carbon leads to carbide aggregation, especially at grain boundaries. Consequently, the creep rupture strength drops, as shown in the Figure, and also the toughness at low temperatures drops. Accordingly, the carbon/nitrogen (C/N) weight ratio should be less than 3:1.

In order to prevent the formation of an undesirable delta-ferrite phase, which decreases the creep rupture strength and low temperature toughness, and to obtain a uniform martensitic structure, it is desirable to hold the chromium-equivalent to 10 or less, as defined by the following equation:

$$\text{Chromium equivalent} = 1\cdot Cr + 6\cdot Si + 4\cdot Mo + 11\cdot V + 2.5\cdot Ta + 5\cdot Cb + 1.5\cdot W - (40\cdot C + 2\cdot Mn + 4\cdot Ni + 30\cdot N),$$

where Cr, Si, Mo, V, Ta, Cb, W, C, Mn, Ni, and N represent the weight percent of each element in the alloy.

Incidental impurities, which are inevitably contained in the alloy, should be kept as low as possible because they impair elevated temperature creep ductility and low temperature toughness.

The present invention will be described in greater detail by the following EXAMPLE.

EXAMPLE

Twelve experimental heats of heat resistant martensitic stainless steel, each containing approximately 12% chromium, were melted in a high frequency induction furnace and poured into small-sized ingots. Table 1 summarizes the chemical composition of each experimental heat. Steel designation 1 through 8 represent the present invention, while 9 through 12 are for comparison purposes, representing conventional alloys.

Ingots were hammer forged, after being heated at 1200° C., to appropriate dimensions for samples to be cut. These samples were then subjected to a heat treatment, simulating the surface layer of a rotor. This heat treatment was as follows:

(1) heating at 1050° C. for 5 hours followed by oil quenching, (2) tempering at 560° C. for 5 hours followed by furnace cooling, and (3) tempering at 660° C. for 24 hours followed by furnace cooling.

Test pieces for a tensile test, Charpy impact test, and creep rupture test were then fabricated from material which received this heat treatment. The results of each test are summarized in Table 2.

It is evident from Table 2 that the steels of the present invention have longer creep rupture times than conventional steels, namely, the steels of the present invention are much superior in creep rupture strength to the conventional steels. In comparison of steel 7 (a steel of the present invention) with steel 12 (a conventional steel), which have nearly equal yield strengths and ultimate tensile strengths, the creep rupture time, tested at 600° C. with an applied stress of 265 MPa, of the inventive steel was 7,200.2 hours, while that of the conventional steel was 1,365.1 hours. The difference between two steels is quite significant.

The heat resistant martensitic stainless steel containing 12% chromium of the present invention is of great engineering value for components which are to be used at high temperatures and under high stress.

TABLE 1

| Steel | Chemical Composition (wt. %) | | | | | | | | | | | | | C/N Weight | Chromium Equivalent |
|---|---|---|---|---|---|---|---|---|---|---|---|---|---|---|---|
| No. | C | Si | Mn | Ni | Cr | Mo | V | W | Cb | Ta | B | N | Fe | Ratio | (%) |
| 1 | 0.08 | 0.07 | 0.60 | 0.78 | 11.1 | 0.96 | 0.29 | — | — | — | — | 0.088 | balance | 0.9 | 8.39 |
| 2 | 0.07 | 0.05 | 0.27 | 0.52 | 10.2 | 1.01 | 0.20 | — | 0.06 | — | — | 0.070 | " | 1.0 | 9.52 |
| 3 | 0.08 | 0.06 | 0.52 | 0.43 | 10.3 | 0.93 | 0.18 | — | — | 0.07 | — | 0.054 | " | 1.5 | 8.96 |
| 4 | 0.10 | 0.02 | 0.30 | 0.31 | 10.2 | 0.98 | 0.21 | — | 0.05 | 0.08 | — | 0.084 | " | 1.2 | 8.64 |
| 5 | 0.11 | 0.10 | 0.74 | 0.68 | 11.3 | 1.12 | 0.19 | 1.0 | 0.04 | — | — | 0.065 | " | 1.7 | 9.62 |
| 6 | 0.11 | 0.07 | 0.87 | 0.45 | 10.5 | 0.95 | 0.20 | 1.2 | — | 0.11 | 0.001 | 0.041 | " | 2.7 | 9.83 |
| 7 | 0.10 | 0.05 | 0.54 | 0.76 | 10.8 | 0.90 | 0.30 | 1.0 | 0.03 | 0.04 | — | 0.077 | " | 1.3 | 9.32 |
| 8 | 0.09 | 0.06 | 0.33 | 0.84 | 10.4 | 0.93 | 0.19 | 0.9 | 0.04 | 0.04 | 0.001 | 0.045 | " | 2.0 | 9.25 |
| 9 | 0.20 | 0.29 | 0.58 | 0.30 | 11.7 | 1.54 | 0.29 | — | — | — | — | 0.035 | " | 5.7 | 11.38 |
| 10 | 0.17 | 0.38 | 0.33 | 0.35 | 12.0 | 1.24 | 0.26 | — | 0.06 | — | — | 0.054 | " | 3.1 | 11.92 |
| 11 | 0.14 | 0.07 | 0.56 | 0.34 | 10.9 | 1.21 | 0.20 | 1.27 | 0.07 | — | — | 0.074 | " | 1.9 | 10.32 |
| 12 | 0.15 | 0.29 | 0.50 | 0.33 | 11.3 | 1.31 | 0.20 | — | — | 0.07 | — | 0.071 | " | 2.1 | 10.21 |

Note:
Steels Nos. 1 to 8: Examples of the present invention
Steels Nos. 9 to 12: Comparative examples

TABLE 2

| Steel No. | 0.02% Yield Strength (MPa) | Tensile Strength (MPa) | Elongation (%) | Reduction of Area (%) | Fracture Appearance Transition Temp. (C.) | Time to Rupture at 600 C., 196 MPa (hours) |
|---|---|---|---|---|---|---|
| 1 | 596.8 | 853.9 | 20.8 | 63.4 | +40 | 6098.4 |
| 2 | 670.3 | 910.3 | 21.5 | 60.8 | +38 | 6485.2 |
| 3 | 683.1 | 923.2 | 21.2 | 60.6 | +36 | 7035.5 |
| 4 | 685.0 | 936.9 | 20.6 | 60.3 | +38 | 7337.6 |
| 5 | 667.4 | 909.4 | 21.3 | 61.5 | +25 | 6872.5 |

TABLE 2-continued

| Steel No. | 0.02% Yield Strength (MPa) | Tensile Strength (MPa) | Elongation (%) | Reduction of Area (%) | Fracture Appearance Transition Temp. (C.) | Time to Rupture at 600 C., 196 MPa (hours) |
|---|---|---|---|---|---|---|
| 6 | 684.0 | 931.0 | 20.8 | 60.3 | +35 | 7263.9 |
| 7 | 669.3 | 913.4 | 21.4 | 61.8 | +29 | 7200.2 |
| 8 | 681.1 | 930.0 | 20.9 | 60.5 | +33 | 7321.4 |
| 9 | 599.8 | 856.5 | 20.8 | 50.3 | +77 | 83.8 |
| 10 | 659.5 | 905.5 | 20.5 | 58.9 | +43 | 992.3 |
| 11 | 666.4 | 918.3 | 20.0 | 56.5 | +52 | 1365.1 |
| 12 | 660.5 | 907.5 | 20.4 | 55.7 | +44 | 1159.2 |

Note:
Steel Nos. 1 to 8: Examples of the present invention
Steel Nos. 9 to 12: Comparative examples

We claim:

1. A heat resistant martensitic stainless steel consisting of, in weight percent, 0.05% to 0.12% carbon, not more than 0.5% silicon, not more than 1.5% manganese, not more than 1.5% nickel, 9.0 to 13.0% chromium, and 0.5 to 2.0% molybdenum, 0.05 to 0.50% vanadium and not more than 0.15% nitrogen, the balance being iron and impurities, and the weight ratio of carbon to nitrogen (C/N) being not more than 3:1.

2. A heat resistant martensitic stainless steel consisting of, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, 0.05 to 0.50% vanadium, not more than 0.15% nitrogen, 0.02 to 0.50% columbium, the balance being iron and impurities, and the weight ratio of carbon to nitrogen (C/N) being not more than 3:1.

3. A heat resistant martensitic stainless steel consisting of, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, 0.05 to 0.50% vanadium, not more than 0.15% nitrogen, 0.0003 to 0.0100% boron, the balance being iron and impurities, and the weight ratio of carbon to nitrogen (C/N) being not more than 3:1.

4. A heat resistant martensitic stainless steel consisting of, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, 0.05 to 0.50% vanadium, not more than 0.15% nitrogen, 0.5 to 2.0% tungsten, the balance being iron and impurities, and the weight ratio of carbon to nitrogen (C/N) being not more than 3:1.

5. A heat resistant martensitic stainless steel consisting of, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, 0.05 to 0.50% vanadium, not more than 0.15% nitrogen, 0.02 to 0.5% tantalum and one of 0.02 to 0.50% columbium, 0.5 to 2.0% tungsten and 0.0003 to 0.0100% boron, the balance being iron and impurities, and the weight ratio of carbon to nitrogen (C/N) being not more than 3:1.

6. A heat resistant martensitic stainless steel consisting of, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, 0.05 to 0.50% vanadium, not more than 0.15% nitrogen, 0.0003 to 0.0100% boron and one of 0.02 to 0.50% columbium, and 0.5 to 2.0% tungsten, the balance being iron and impurities, and the weight ratio of carbon to nitrogen (C/N) being not more than 3:1.

7. A heat resistant martensitic stainless steel consisting of, in weight percent, 0.05% to 0.12% carbon, not more than 0.5% silicon, not more than 1.5% manganese, not more than 1.5% nickel, 9.0 to 13.0% chromium, 0.5 to 2.0% molybdenum, 0.05 to 0.50% vanadium, not more than 0.15% nitrogen, at least three of 0.02 to 0.50% columbium, 0.02 to 0.5% tantalum, and 0.5 to 2.0% tungsten and 0.0003 to 0.0100% boron, the balance being iron and impurities, and the weight ratio of carbon to nitrogen (C/N) being not more than 3:1.

* * * * *